US008430697B2

(12) United States Patent
Gassauer et al.

(10) Patent No.: US 8,430,697 B2
(45) Date of Patent: Apr. 30, 2013

(54) PLUG-TYPE CONNECTOR AND MATING PLUG-TYPE CONNECTOR

(75) Inventors: Stephan Gassauer, Ilfeld (DE); Jens Froebing, Gotha (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 199 days.

(21) Appl. No.: 13/037,760

(22) Filed: Mar. 1, 2011

(65) Prior Publication Data

US 2011/0217879 A1 Sep. 8, 2011

(30) Foreign Application Priority Data

Mar. 3, 2010 (DE) ..... 10 2010 010 259

(51) Int. Cl.
*H01R 4/48* (2006.01)

(52) U.S. Cl.
USPC ..... 439/835; 439/441; 439/828

(58) Field of Classification Search ..... 439/835, 439/712, 715, 660, 436, 437, 438, 439, 440, 439/441, 828
See application file for complete search history.

(56) References Cited

U.S. PATENT DOCUMENTS

| | | | | |
|---|---|---|---|---|
| 5,626,488 | A * | 5/1997 | Albeck et al. | 439/395 |
| 6,293,816 | B1 * | 9/2001 | Scheitz et al. | 439/441 |
| 6,786,779 | B2 * | 9/2004 | Feldmeier et al. | 439/729 |
| 8,292,677 | B2 * | 10/2012 | Gassauer | 439/729 |

FOREIGN PATENT DOCUMENTS

| | | | |
|---|---|---|---|
| DE | 83 25 310 | U1 | 2/1985 |
| DE | 41 02 774 | A1 | 8/1992 |
| DE | 195 00 156 | A1 | 7/1995 |
| DE | 44 20 984 | A1 | 12/1995 |
| DE | 102007052462 | A1 | 5/2009 |
| EP | 0 235 339 | A1 | 10/1990 |
| EP | 0 392 629 | A1 | 10/1990 |

* cited by examiner

*Primary Examiner* — Hae Moon Hyeon
(74) *Attorney, Agent, or Firm* — Whitam Curtis Christofferson & Cook, PC

(57) ABSTRACT

The plug-type connector with an insulating housing, with conductor insertion openings for inserting electrical conductors, which are aligned next to one another in a connection plane, extend in a plug-in direction and lead from a connection side into the interior of the insulating housing, with mating contact receiving openings for receiving mating contacts of a mating plug-type connector, which are aligned next to one another in a plug-in plane and extending from a plug-in side into the interior of the insulating housing, and with grooves in the insulating housing which extend in the plug-in direction. The grooves are arranged offset to the conductor insertion openings and the mating contact receiving openings and partially enter an interspace between adjacent conductor insertion openings. The grooves extend from the connection side to the plug-in side over the entire length of the plug-type connector.

11 Claims, 12 Drawing Sheets

PLUG-TYPE CONNECTOR AND MATING PLUG-TYPE CONNECTOR

FIELD OF INVENTION

The invention relates to a plug-type connector with an insulating housing, with at least two conductor insertion openings for inserting electrical conductors, which conductor insertion openings are aligned next to one another in a connection plane, extend in a plug-in direction and lead from a connection side of the plug-type connector into the interior of the insulating housing, with at least two mating contact receiving openings for receiving mating contacts of a mating plug-type connector, said mating contact receiving openings being aligned next to one another in a plug-in plane and extending from a plug-in side of the plug-type connector, which is opposite the connection side, into the interior of the insulating housing, with in each case one spring force connection element per conductor insertion opening, which spring force connection elements are shaped and accommodated in the insulating housing in such a way that they are operatively connected to in each case one associated electrical conductor inserted in a conductor insertion opening in order to connect the electrical conductor in electrically conductive fashion to a mating contact, and with grooves in the insulating housing which extend in the plug-in direction.

Furthermore, the invention relates to a mating plug-type connector for such a plug-type connector with an insulating housing and with mating contacts, which extend in the insulating housing parallel to one another at a distance in the plug-in direction, and with guide webs for forming guides of coding pins.

BACKGROUND

Plug-type connectors and mating plug-type connectors with a wide variety of embodiments are sufficiently well known per se. In order to prevent plug-type connectors and mating plug-type connectors from being connected erroneously, coding elements are used.

DE 83 25 310 U1 has disclosed a coding apparatus for multiple plug-type connections. Each plug-type connection half has coding element holding apparatuses, with it being possible for coding elements to be inserted into the cutouts in said coding element holding apparatuses, said coding elements being capable of being manipulated separately, being reusable and being produced with a fastening section. The coding element holding apparatuses are formed integrally on the plug holder and directly adjacent to the male connector strip and so as not to protrude laterally with respect to the end face of the plug holder holding the male connector strip and as an extension of said plug holder in the plug-in direction.

Similar coding systems are also described in DE 195 00 156 A1, EP 0 392 629 A1 and DE 41 02 774 A1.

DE 44 20 984 A1 has disclosed a codable plug-type connector, in which profiled grooves are provided for coding purposes, said profiled grooves being associated with a plug part and, within the jack part, in each case the individual pole and coming to bear against one another in sliding fashion when the plug-type connector is assembled. Coding elements can be inserted into the profiled grooves. A raised conductor connection section with screw terminals adjoins the profiled grooves. A similar embodiment is also described in DE 10 2007 052 462 A1, in which at least one clamping shoe, which can be inserted into a coding channel, is integrally formed on a contact jack.

EP 0 235 339 A1 has disclosed a multipole plug-type connector, in which assembly of the plug and jack parts is prevented by virtue of the fact that matable contouring formed from ribs and grooves and following a predetermined pitch is provided in the central subregion on the contour which interacts during assembly. The end edges of the contouring are formed differently from the pitch of the contouring in the central subregion in order to bring about a collision when an attempt at erroneous plugging is made. The plug and jack parts are furthermore provided with receptacles for coding elements, with which undesired plugging operations of the plug parts and jack parts can be prevented given the same number of poles.

The coding grooves for receiving coding elements take up a relatively large amount of space and do not have any further useful function other than coding and latching.

SUMMARY

The object of the present invention is therefore to provide an improved plug-type connector for the mating plug-type connector.

The object is achieved by the plug-type connector of the type mentioned at the outset in such a way that the grooves are arranged offset with respect to the conductor insertion openings and the mating contact receiving openings and at least partially enter an interspace between two adjacent conductor insertion openings, and that the grooves extend from the connection side to the plug-in side over the entire length of the plug-type connector.

The invention proposes not only arranging the groves on the connection side facing the mating plug-type connector, but continuing said grooves as far as the opposite conductor connection side. In this case, the grooves are moved into the plane of the conductor insertion openings for better utilization of space and, for this purpose, are arranged offset with respect to the conductor insertion openings in the interspace between two adjacent conductor insertion openings. For example, the physical size of the plug-type connectors can advantageously be reduced in the width direction. The grooves can be used not only for receiving coding elements in the direction of the connection side for the mating plug-type connector, but also for coupling further elements, such as in particular a strain-relief device for the electrical conductors to be connected or a grip element for facilitating manipulation, on the opposite side.

For this purpose, the grooves preferably have latching receptacles for receiving latching elements of coding pins.

In addition, the grooves can preferably be formed on the connection side for receiving at least one strain-relief or gripping element and, for this purpose, can have, adjacent to the connection side, latching receptacles for receiving latching elements of the at least one strain-relief or gripping element.

It is particularly advantageous if the grooves widen so as to taper at an angle with respect to the connection side. The side walls of the grooves should preferably be connected to one another by a transverse bar adjoining the connection side and should be open towards the bearing face which is transverse to the connection side. Therefore, a shoulder of a latching section which tapers in the form of a wedge can spring into the opening adjoining the transverse bar at a free end of a strain-relief element, and the strain-relief element can latch with the shoulder abutting the transverse bar.

It is also advantageous if the grooves are open from the plug-in side, to which a mating plug-type connector can be connected, in the direction of the connection side towards the bearing face which is transverse to the outer side. In this embodiment, the grooves are not in the form of a tunnel which is closed in cross section, but in the form of a channel which is open in cross section towards one side. The channel has latching and guide sections for receiving and for holding coding elements which are inserted into the channel.

In the context of the present invention, however, grooves are understood not only to mean such a channel which is open on one side, but all other conceivable cross sections, including a tunnel which is closed on all sides, which are suitable for receiving coding elements.

Furthermore, the invention is achieved by a mating plug-type connector of the type mentioned at the outset in that the guide webs are arranged in such a way that the guide webs are guided and held by the guide webs between in each case two adjacent mating contacts, parallel to the plug-in plane, which is covered by the mating contacts and is aligned in the plug-in direction.

In this case too, the guide webs are arranged offset with respect to the mating contacts and are thus matched to the space-saving arrangement of the grooves of the plug-type connector.

It is particularly advantageous if clamping projections are arranged in the guides, said clamping projections interacting with a respective fork with two mutually spaced apart clamping limbs at one free end of a coding pin in such a way that the clamping limbs of a fork engage around a clamping projection on both sides and fix a coding pin on a clamping projection. It is possible in a simple and space-saving manner to secure a coding pin on the mating plug-type connector with the aid of such a clamping projection which can be enclosed on both sides.

The invention is furthermore achieved by a set of plug-type connectors and mating plug-type connectors of the type described above.

It is advantageous when the coding pins for the plug-type connectors are configured differently from the coding pins for the mating plug-type connectors in order thus to enable coding which is matched to one another and which is matched to the different spatial requirements of the plug-type connector and mating plug-type connector in optimum fashion.

In this case, the contour of the grooves for the coding pins over the contour of the coding pins and/or the latching elements or coding pins provided for latching on the plug-type connector and mating plug-type connector as well as the correspondingly matched formation of the latching receptacles for plug-type connectors and mating plug-type connectors should be configured differently from one another.

DESCRIPTION OF THE DRAWINGS

The invention will be explained in more detail below with reference to an exemplary embodiment with the attached drawings, in which.

DETAILED DESCRIPTION

Figure 1:
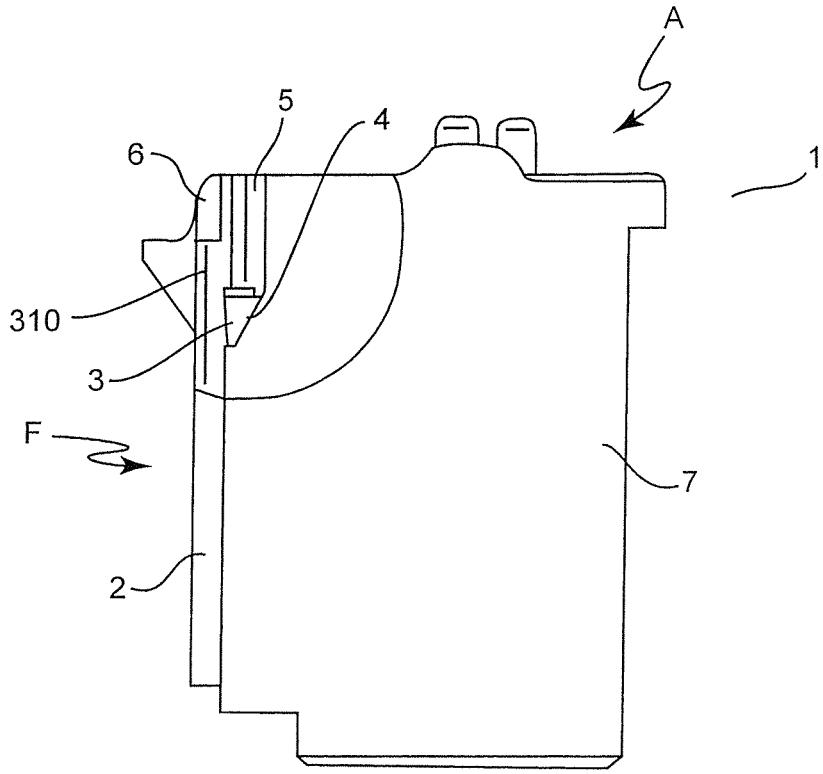
FIG. 1 shows a side view of a partial section of a plug-type connector.

FIG. 1 shows a side view of a partial section through a plug-type connector 1, which has a connection side A for connecting electrical conductors and, opposite, a plug-in side S for positioning a mating-plug-type connector. Grooves 2, which extend from the connection side A to the plug-in side S and are open towards the connection side A and plug-in side S, are provided on the rear side (on the left) of the plug-type connector 1.

The grooves 2 widen towards the connection side A in a latching region 3 by virtue of a run-up ramp 4 and a latching opening 5 being formed. The grooves 2 are each closed partially by a transverse bar 6 in the region adjoining the connection side A. The transverse bar 6 is adjoined by an opening 310 in the side face F.

Figure 2A:
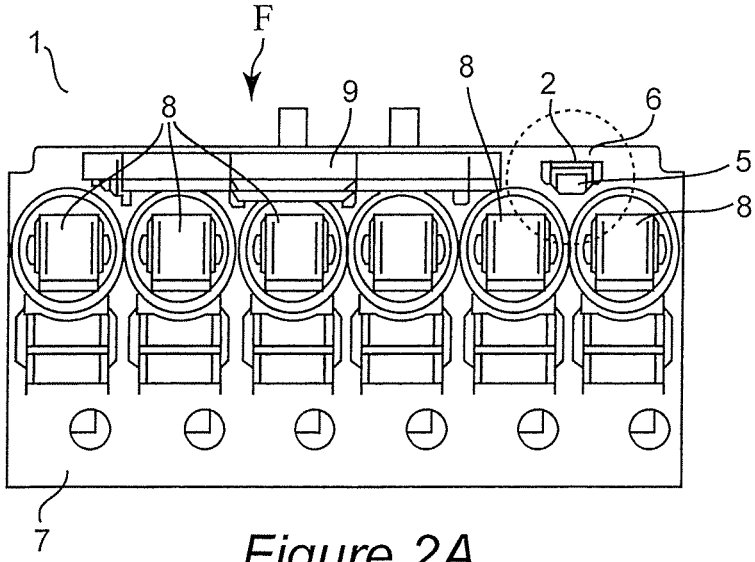
FIG. 2*a* shows a front view of the connection side of the plug-type connector shown in FIG. 1.

FIG. 2*a*) shows a front view of the connection side A of the plug-type connector 1 shown in FIG. 1. It is clear that a large number of conductor insertion openings 8 arranged next to one another and opening out into a conductor connection area in a manner known per se are introduced into the insulating housing 7 of the plug-type connector 1. In each case one clamping spring for clamping an electrical conductor which has been inserted into the conductor insertion opening 8 against a contact pin is provided in the conductor connection area, said contact pin being guided from the plug-in side S into the plug-type connector 1 into an associated conductor connection area.

The figure clearly shows the groove 2 with the latching opening 5, said groove being partially closed by the transverse bar 6. This groove 2 is arranged offset with respect to the two adjacent conductor insertion openings 8 and enters partially into the interspace between two of the adjacent conductor insertion openings 8 through its latching opening 5, with the result that optimum use is made of the available space in the plug-type connector 1.

FIG. 2*a*) also shows that a strain-relief element 9 is inserted into the adjacent grooves and latched to the respective groove in the latching region 3.

Figure 2B:
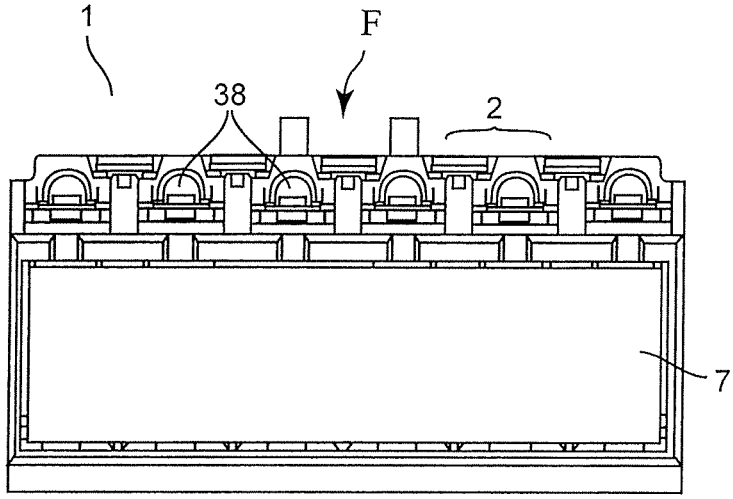
FIG. 2*b* shows a front view of the plug-in side of the plug-type connector.

FIG. 2*b*) shows the plug-type connector 1 in the view of the plug-in side S. The figure shows the mating contact receiving openings 38, which each open out into an associated conductor connection area.

Figure 3:
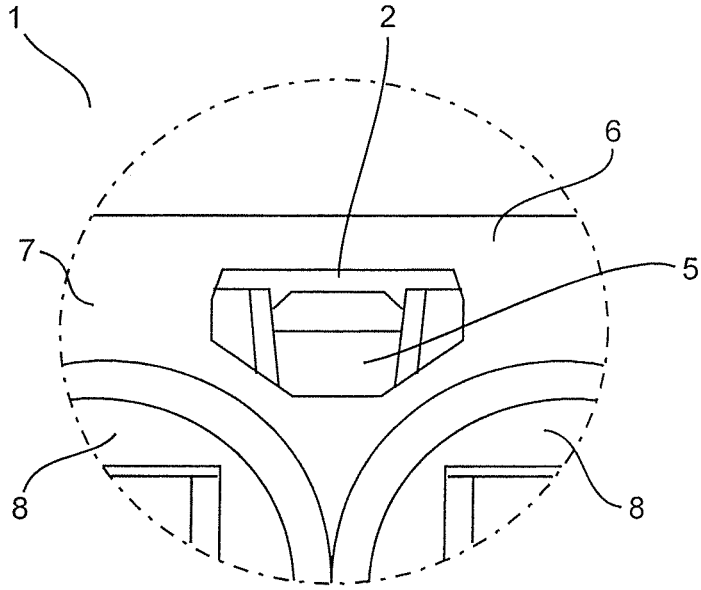
FIG. 3 shows a detail view of the connection side of the plug-type connector in the region of the groove arranged between two conductor insertion openings.

FIG. 3 shows the detail view of the connection side A of the plug-type connector 1 in the region of the groove 2. This figure shows more clearly how the groove 2 partially enters the interspace between two adjacent conductor insertion openings 8 in order to be received in the insulating housing 7 of the plug-type connector 1 in optimized fashion in terms of space.

Figure 4:
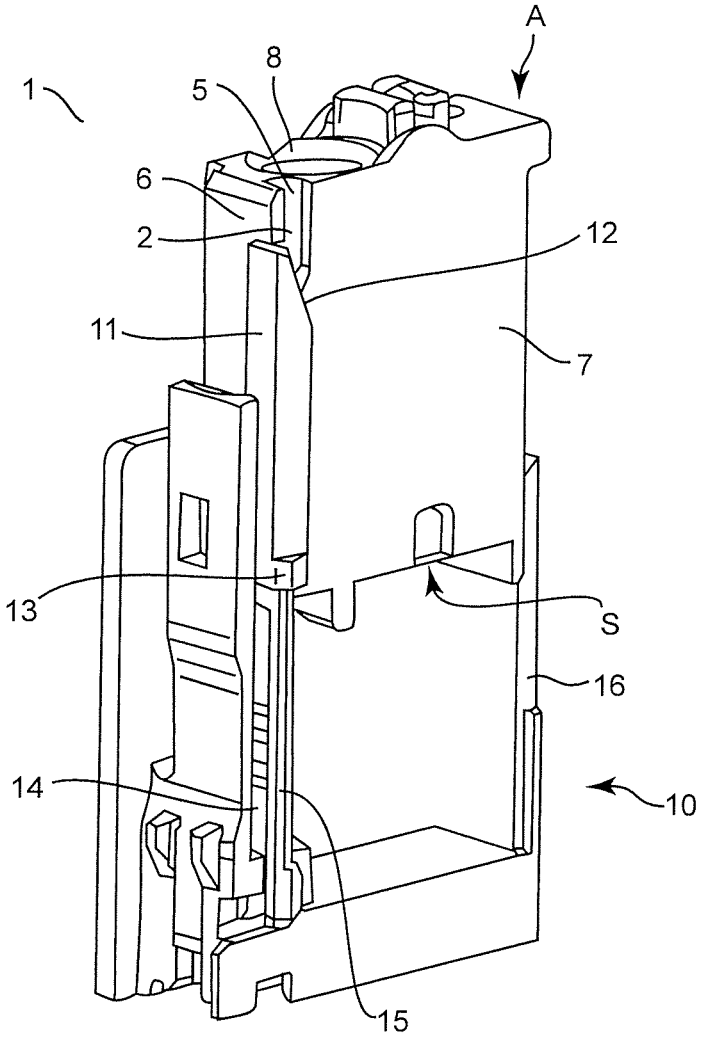
FIG. 4 shows a perspective sectional view of a mating plug-type connector with the plug-type connector and coding pin partially plugged on from the rear side of the mating plug-type connector.

FIG. 4 shows a perspective sectional view of a mating plug-type connector 10 with a partially inserted plug-type connector 1 from FIGS. 1 and 2. It is clear how a coding pin 11 is inserted into a groove 2 of the plug-type connector 1 from the plug-in side S in the direction of the connection side A. The coding pin 11 has a bearing face 12, which tapers at an angle towards the free end in the direction of the connection side A and tabs 13 which protrude laterally at the opposite free end for entering and possibly latching into corresponding receptacles in the groove 2. It can be seen that the mating plug-type connector 10 has a corresponding coding pin 14, on which the coding pin 11 of the plug-type connector 1 can be positioned and the plug-type connector 1 is prevented from entering the mating plug-type connector 10 any further and therefore erroneous plugging is prevented. The coding pin 14 is guided laterally on projecting guide rails 15 in guide webs (see reference 32 in FIG. 15) with a contour of the insulating housing 16 of the mating plug-type connector 10 which is matched to the guide rails 15.

Figure 5:
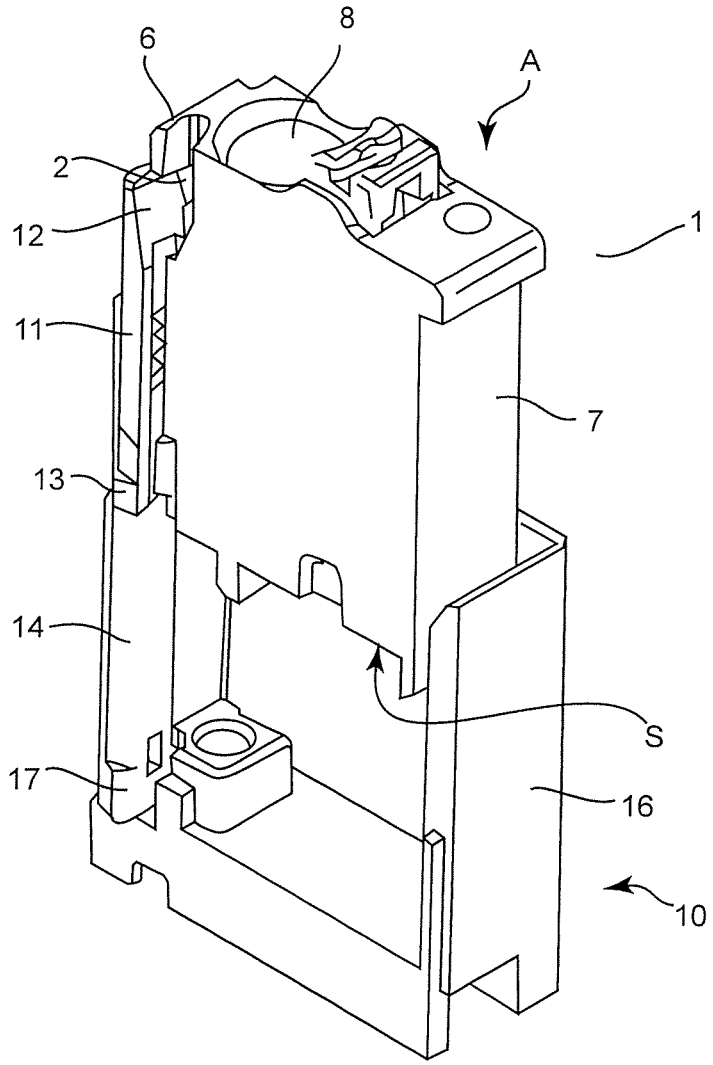
FIG. 5 shows a perspective sectional view of the mating plug-type connector and plug-type connector shown in FIG. 3 from the front side.

The installed situation illustrated in FIG. 4 is once again shown in FIG. 5, but this figure shows a perspective sectional view of the mating plug-type connector 10 and the plug-type connector 1 from the front side.

It becomes clear here that the coding pins 11 for the plug-type connector 1 are configured differently from the coding pins 14 for the mating plug-type connector 10. The coding pins 14 for the mating plug-type connector 10 also have two mutually opposite tabs 17, which project laterally relative to the adjoining contour of the coding pin 14, for fixing the coding pins 14 at the free end of that coding pin 14 which completely enters the plug-type connector 10.

Figure 6:
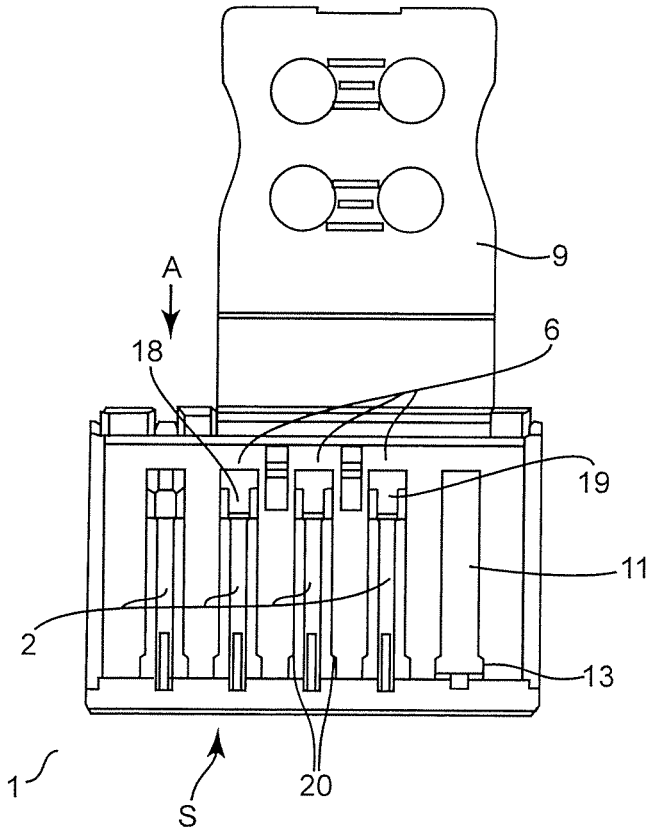
FIG. 6 shows a plan view of a plug-type connector with a strain-relief unit inserted into grooves on the connection side.

FIG. 6 shows a plan view of the plug-type connector 1 with the strain-relief element 9 shown in FIG. 2 positioned thereon. The figure shows how latching elements 18 of the strain-relief element, said latching elements protruding at the free end of the strain-relief element 9, enter associated grooves 2 on the connection side A and latch with the plug-type connector 1 behind the respective transverse bar 6. For this purpose, latching projections 19 of the latching elements 18 protrude in the groove behind the transverse bar 6 and form, together with the transverse bar 6, a stop which prevents the strain-relief element 9 from being withdrawn from the plug-type connector 1.

The figure also shows that the grooves 2 each run out through widened cutouts 20 on the plug-in side S, which is provided for the positioning of a mating plug-type connector. Corresponding tabs 13 of the coding pins 11 for the plug-type connector 1 enter the cutouts 20. This becomes clearer from the coding pin 11 placed on the right-hand groove 2. It can also be seen from this that the free end of the coding pin 11 partially overlaps the latching element 18 of the strain-relief element 9 adjacent to the connection side A.

Figure 7:
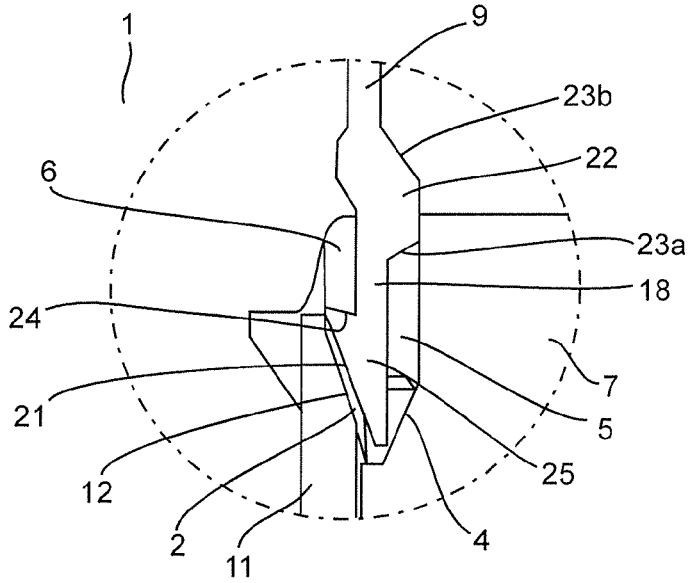
FIG. 7 shows a detail view of the overlap between the strain-relief element and coding pin in the latching region of the plug-type connecting connector.

FIG. 7 shows a detail view in the region of overlap between the coding pin 11 and the strain-relief element 9. It becomes clear that the bearing bevel 12 of the coding pin 11 adjoins a bearing bevel 21 of the latching element 18 of the strain-relief element 9. This bearing bevel 21 of the latching element 18 is formed by a conically tapering free end of the latching element 18.

It can furthermore be seen that the latching element 18 has a protuberance 22, which partially enters the latching opening 5 in the groove 2 and merges on both sides with runup bevels 23*a*, 23*b* into a latching section 25. The protuberance 22 is opposite a shoulder 24 of the latching section 25 which tapers in the form of a wedge, said shoulder 24 being latched to the transverse bar 6 of the insulating housing 7 of the plug-type connector 1. The protuberance 22 first of all makes it possible for the latching section 25 to be inserted into a latching opening 5 easily, wherein, by virtue of the runup bevel 4 of the groove 2 and by virtue of the protuberance 22, the latching section 25 is pushed into the free region of the groove behind the transverse bar 6 (on the left hand side) and thus latches the strain-relief element securely on the plug-type connector 1.

Figure 8:
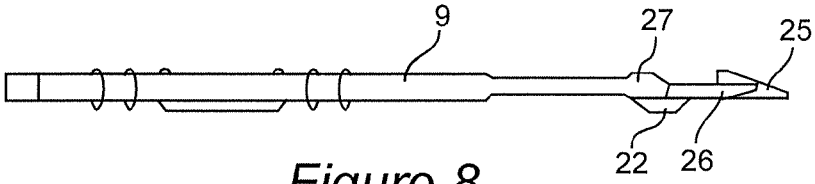
FIG. 8 shows a side view of an embodiment of a strain-relief unit.

FIG. 8 shows a side view of the strain-relief element. The figure clearly shows the conically tapering latching section 25. In opposition to this, a section 26 which tapers conically in the direction of the free end is provided on the side faces. The projection 22, which merges with an elevation 27 opposite, is arranged opposite the latching section 25 and the free end in a manner offset towards the rear.

Figure 9:
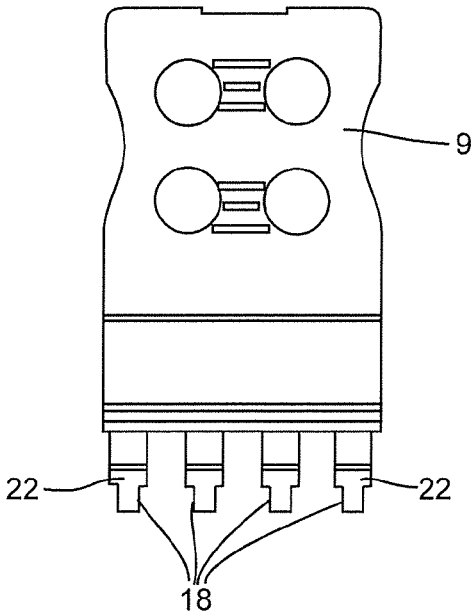
FIG. 9 shows a plan view of the lower side of the strain-relief element shown in FIG. 12.

FIG. 9 shows a plan view of the strain-relief element 9 from the lower side. It is clear that latching elements 18 which protrude in the manner of fingers are provided at a distance from one another which is matched to the distance between the grooves 2 of the plug-type connector 1, and the projections 22 are arranged on the lower side of said latching elements.

Figure 10:
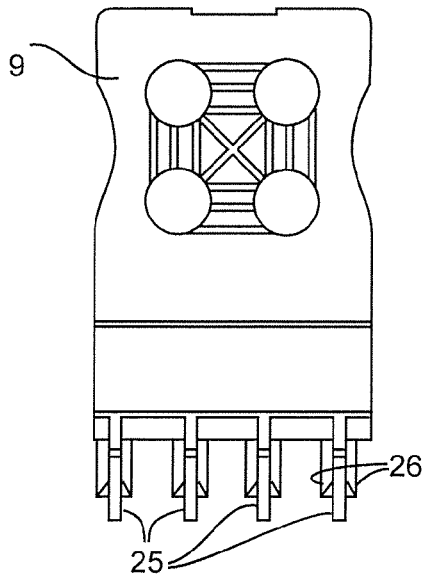
FIG. 10 shows a plan view of the upper side of the strain-relief element shown in FIG. 12.

FIG. 10 shows the view of the strain-relief element 9 from the other side. The latching sections 25 which taper in the form of wedges and the sections 26 which taper in the form of wedges in opposition thereto and laterally adjacent thereto are clearly shown.

Figure 11:
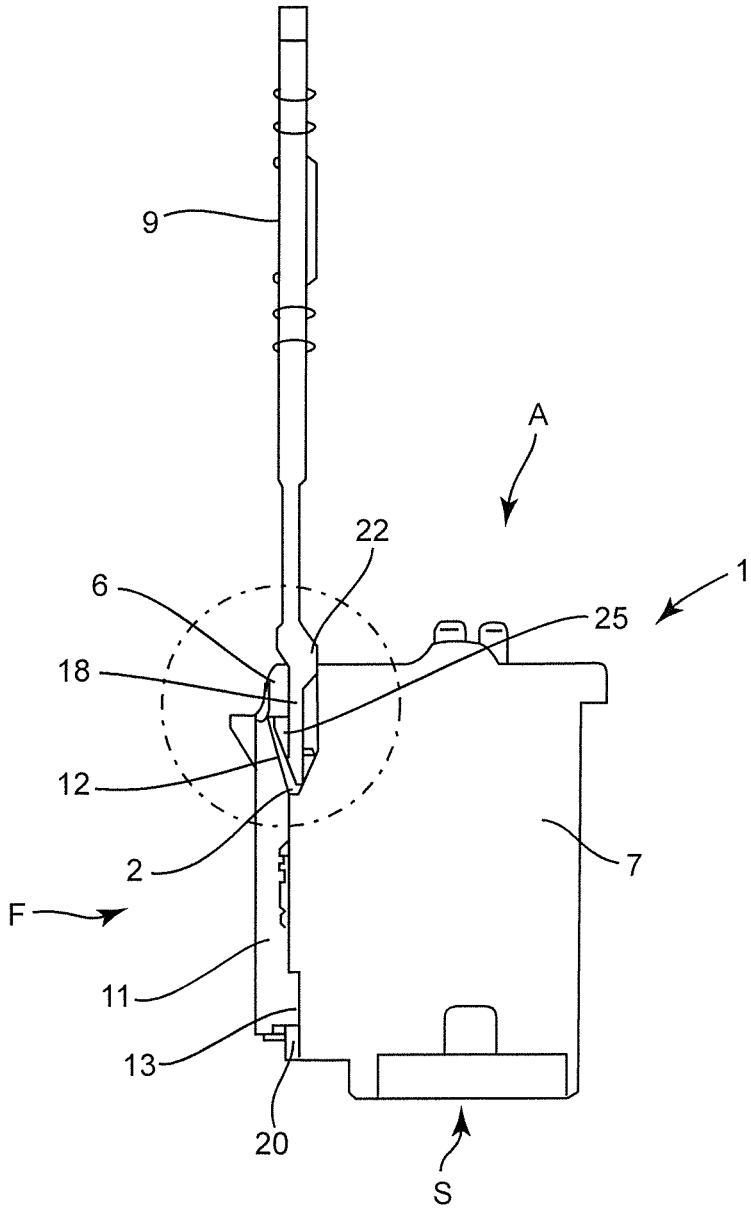
FIG. 11 shows a side view of a section through the plug-type connector with the strain-relief element inserted and the coding pin bearing against said strain-relief element.

FIG. 11 once again shows a side view of the plug-type connector 1 with the strain-relief element 9 and the coding pin 11 inserted. This figure shows more clearly, in combination with FIG. 7, the way in which the strain-relief element 9 is latched on the transverse bar 6 and the way in which the coding pin 11 and the latching section 25, which tapers in the form of a wedge, of the latching element 18 overlap one another.

It can also be seen clearly that the coding pin 11 enters a recess 20 in the groove 2 at the opposite free end with the projecting tab 13.

Figure 12A:
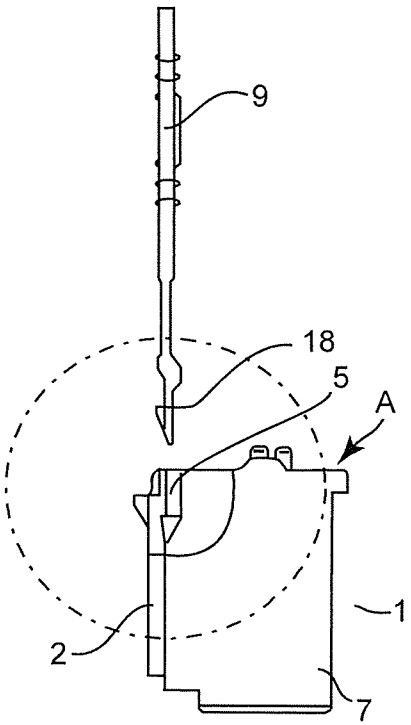
FIGS. 12*a*)-*c*) show side views of a section through a plug-type connector with a strain-relief unit in the process of being inserted onto the connection side.

FIGS. 12*a*) to *c*) show the process for the insertion of a strain-relief element 9 into a groove 2 and latching thereof on the transverse bar 6. The adjacently arranged latching elements 18 of the strain-relief element 9 are inserted into associated latching openings 5 in the grooves 2 on the connection side A of the plug-type connector 1 (FIG. 12*a*) and *b*)). The projection 22 in this case still protrudes laterally beyond the latching opening 5 and initially prevents further insertion of the strain-relief element 9. For this purpose, the strain-relief element 9 needs to be pushed downwards by means of pressure being applied and in this case tilted slightly to the side, with the result that the projection 22 enters the latching opening 5 with the aid of the insertion bevel 23*a*. In the process, the free end of the latching section 18 which tapers in the form of a wedge slides on the insertion bevel 4 of the latching opening 5 in the direction of the opening of the groove 2 and guides the latching section 18 which tapers in the form of a wedge behind the transverse bar 6. In this way, a shoulder 24 of the latching section which tapers in the form of a wedge is positioned behind the transverse bar 6 and prevents the strain-relief element 9 from being withdrawn from the latching receptacles formed in each case by a groove 2 with a transverse bar 6 and the latching opening.

In order to withdraw the strain-relief element 9 from the plug-type connector 1, it is necessary to use a tool, with which the shoulder 24 of the latching section 18 which tapers in the form of a wedge is pushed downwards using the elasticity of the plastics material of the strain-relief element 9 in order thus to make it possible for the strain-relief element 9 to be withdrawn.

Figure 12B:
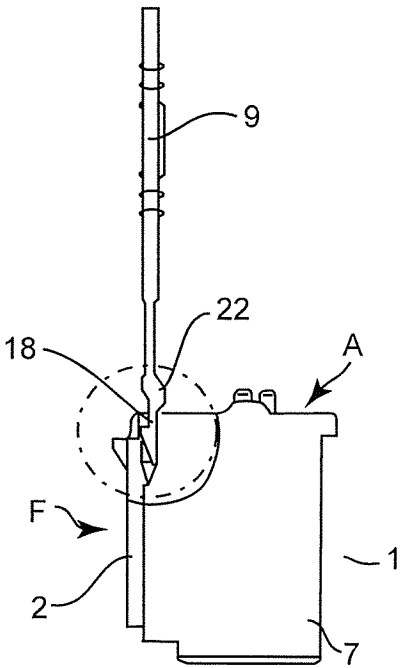
Figure 12C:
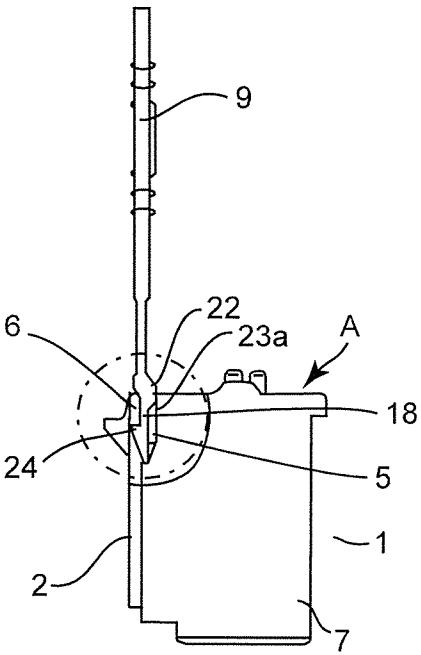
Figure 13C:
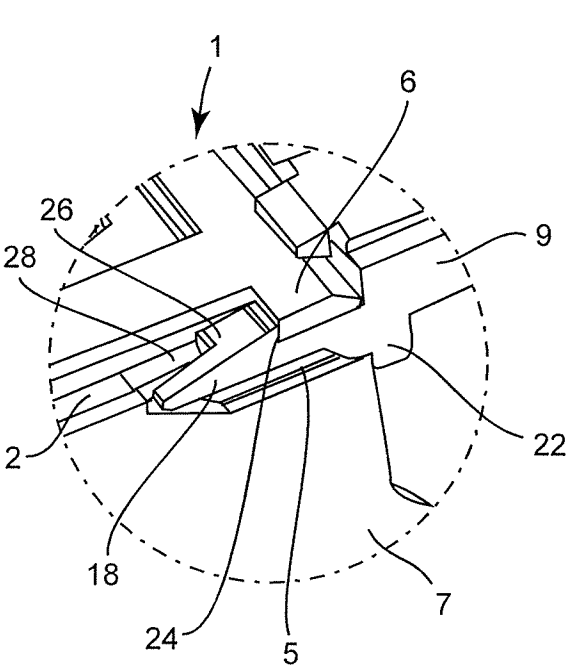
FIGS. 13*a*)-*c*) show detail views of the latching region of the strain-relief element in the mating plug-type connector.
Figure 13B:
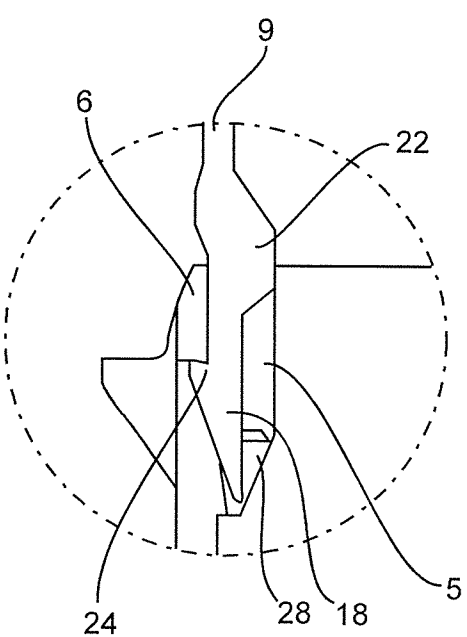
Figure 13A:
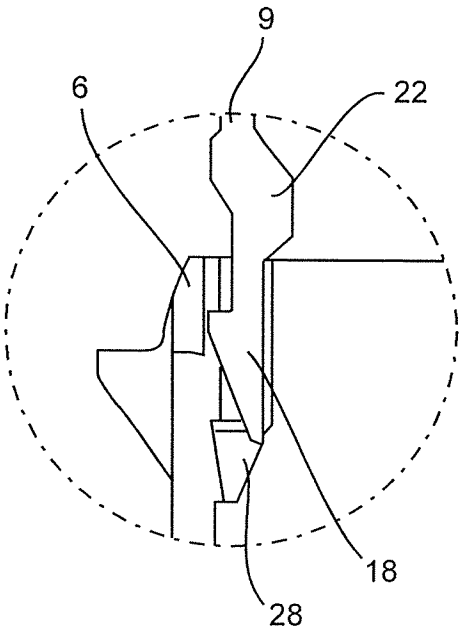

FIGS. 13*a*) and *b*) show a detail view of the latching region when the strain-relief element 9 is inserted as shown in FIGS. 12*b*) and *c*). FIG. 13*c*) shows a detail view in plan view as a perspective of the rear side of the plug-type connector 1 with the strain-relief element 9 inserted. The way in which the shoulder 24 of the latching section 18 which tapers in the form of a wedge latches behind the transverse bar 6 becomes clear here. It also becomes clear that the groove 2 is not open at the bottom in the latching opening so as to form the latching opening 5 over the entire width, but has a section 28 in which the lateral section 26 adjoins.

Figure 14:
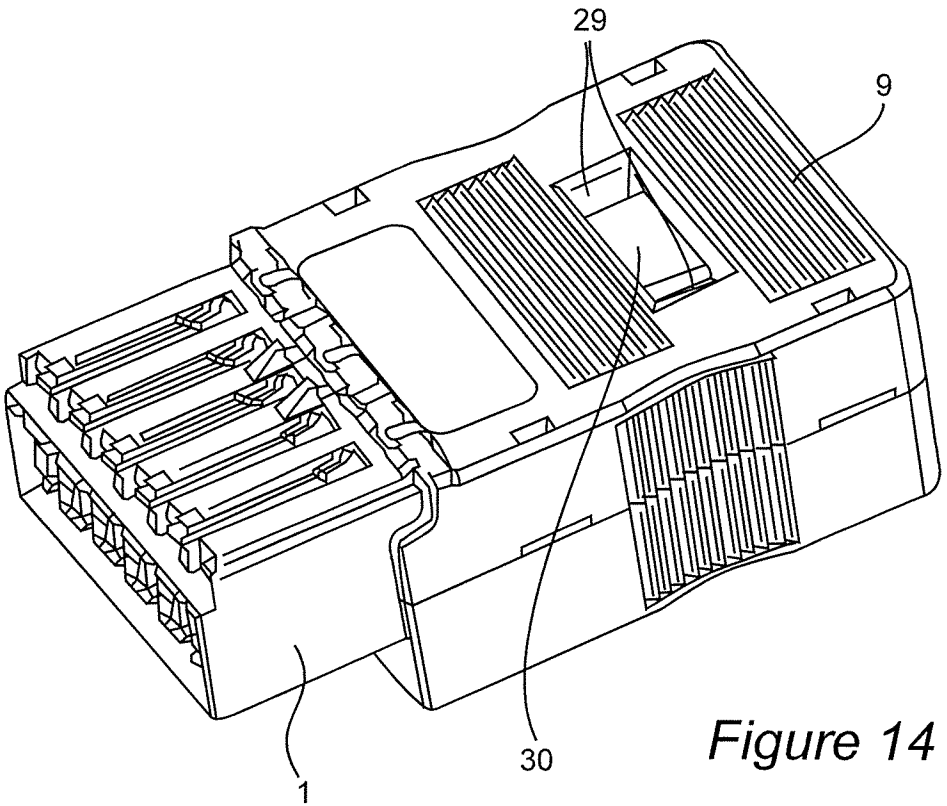
FIG. 14 shows a perspective view of another embodiment of a strain-relief unit which has been placed onto a plug-type connector.

FIG. 14 shows a perspective view of another embodiment of a strain-relief element 9. The latching of this strain-relief element to the plug-type connector 1 is performed in the manner described above. However, the strain-relief element 9 is closed laterally by front and rear walls and side walls and has a conductor leadthrough opening for at least one electrical conductor or a conductor bundle on the side opposite the plug-type connector 1. The strain-relief element 9 in this way forms a type of plug, at which the electrical conductors guided into the plug-type connector 1 can be bundled together. For this purpose, a cable tie leadthrough formed from two openings 29 and a transverse bar 30 between the openings is provided on a wall. A cable tie can be guided through the two opposite openings 29 around the transverse bar 30 in order then to fasten the electrical conductors located in the interior of the strain-relief element 9 on the strain-relief element 9.

Figure 15:
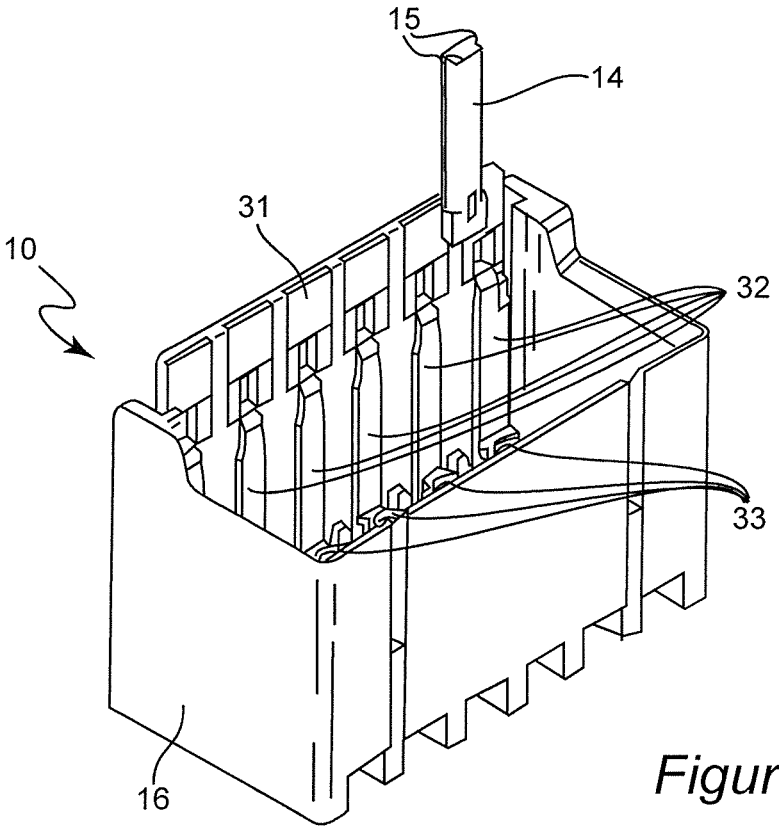
FIG. 15 shows a perspective view of a mating plug-type connector with a coding pin.

FIG. 15 shows a perspective view of a mating plug-type connector 10, which has guide webs 32 on the rear wall 31 of the insulating housing 16. In this case, the guide webs 32 are arranged adjacent to associated mating contacts or openings 33 for inserting mating contacts in such away that the space between the guide webs 32 is located in the interspace between two adjacent mating contacts or adjacent mating contact openings 33. The guide webs 32 are configured in the form of a dovetail guide, for example, in such a way that a coding pin 14 can be inserted between two guide webs 32. The coding pins 14 are thus guided and held by the guide webs 32 between in each case two adjacent mating contacts or mating contact openings 33, parallel to the plug-in plane, which is covered by the mating contacts and is aligned in the web direction.

Figure 16:
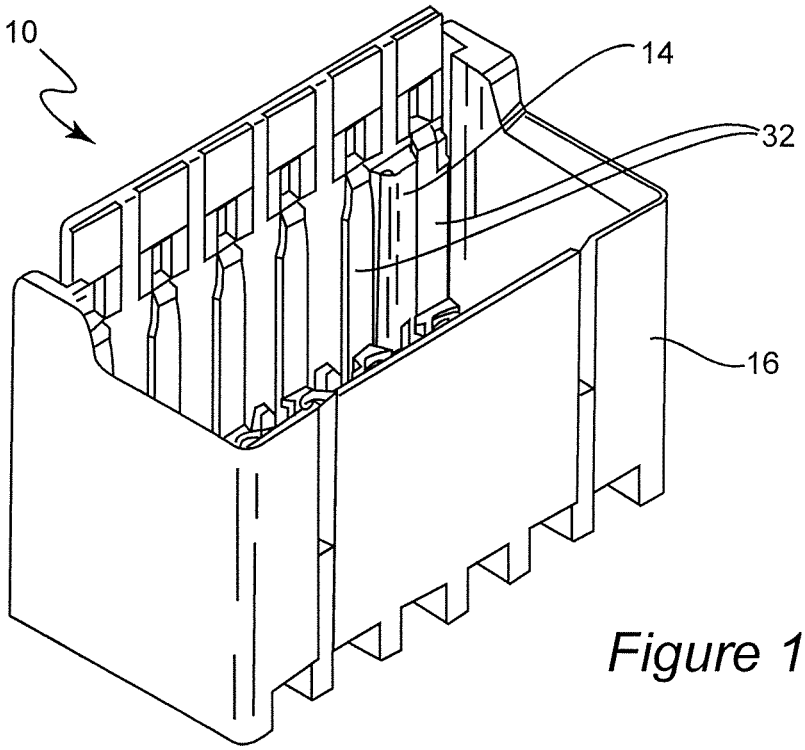
FIG. 16 shows a perspective view of the mating plug-type connector shown in FIG. 15 with the coding pin inserted.

On the other hand, FIG. 16 shows the plug-type connector 10 shown in FIG. 15 with the coding pin 14 completely inserted.

Figure 17:
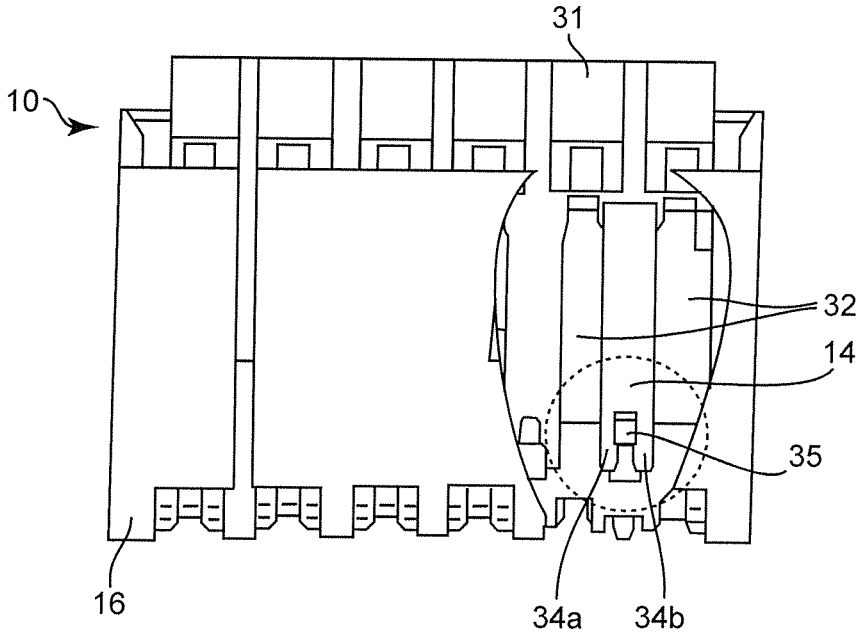
FIG. 17 shows a front view of a partial section through the mating plug-type connector shown in FIG. 16 with the coding pin inserted.

FIG. 17 shows this installed situation in a front view in partial section. The figure shows that the coding pin 14 has, at the lower free end, a fork on the side facing the housing wall with two clamping limbs 34*a*, 34*b*, which are spaced apart from one another and which engage around a clamping projection 35 on both sides which is arranged in the interspace between two adjacent guide webs 32. Projections on the clamping limbs 34*a*, 34*b* form a stop and prevent the coding pin 14 from falling out. Instead, the coding pin 14 is fixed on the clamping projection 35 in this way.

Figure 18:
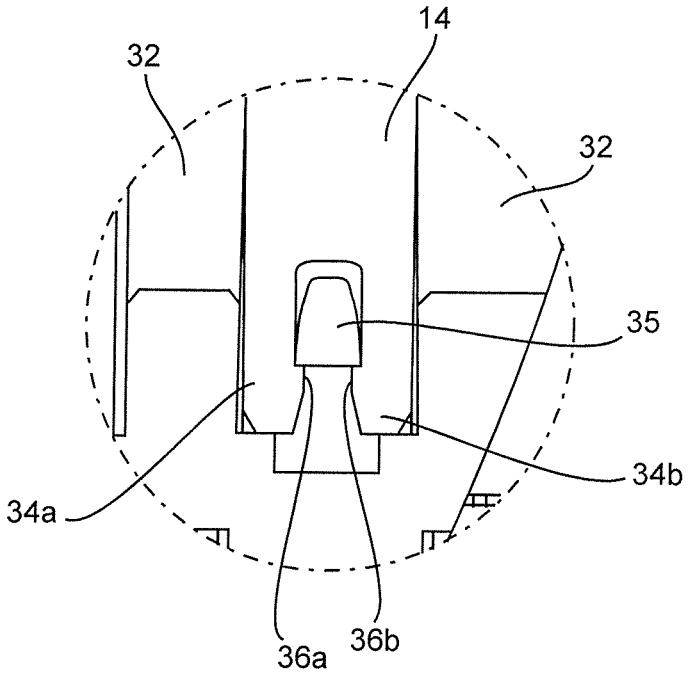
FIG. 18 shows a detail view of the mating plug-type connector with a coding pin in the region of latching on a clamping projection.

This becomes even clearer from the enlarged detail view in FIG. 18. In this case, the projections 36*a*, 36*b* on the two spaced-apart clamping limbs 34*a*, 34*b* can be seen more easily. The figure also shows how these clamping limbs 34*a*, 34*b* engage around the clamping projection on both sides and fix the coding pin 14 on the clamping projection 35 with the aid of the projections 36*a*, 36*b*.

The invention claimed is:

1. A plug-type connector comprising:

an insulating housing, with at least two conductor insertion openings for inserting electrical conductors, wherein said conductor insertion openings are aligned next to one another in a connection plane, extend in a plug-in direction and lead from a connection side of the plug-type connector into an interior of the insulating housing;

at least two mating contact receiving openings aligned next to one another in a plug-in plane and extending from a plug-in side of the plug-type connector, which is opposite the connection side, into the interior of the insulating housing; and grooves in the insulating housing which extend in the plug-in direction, wherein the grooves are arranged offset with respect to the conductor insertion openings and the mating contact receiving openings and at least partially enter an interspace between two adjacent conductor insertion openings, and the grooves extend from the connection side to the plug-in side over the entire length of the plug-type connector.

2. The plug-type connector according to claim 1, wherein the grooves have latching receptacles for receiving latching elements of coding pins.

3. The plug-type connector according to claim 1, wherein the grooves are formed, starting from the connection side, to receive at least one strain-relief or gripping element and have, adjacent to the connection side, latching receptacles for receiving latching elements of the at least one strain-relief or gripping element.

4. The plug-type connector according to claim 3, wherein the grooves deepen in a manner tapering at an angle towards the connection side and are open towards a side face, which is transverse to the connection side, behind a transverse bar, which connects the side walls of the groove to one another and adjoins the connection side, with the result that a shoulder of a latching section, which tapers in the form of a wedge, springs into an opening in the side face adjoining the transverse bar at a free end of a strain-relief or gripping element, and the strain-relief or gripping element can latch with the shoulder bearing against the transverse bar.

5. The plug-type connector according to claim 1, wherein the grooves are open from the plug-in side in the direction of the connection side towards a side face which is transverse to the connection side.

6. A mating plug-type connector for a plug-type connector with a first insulating housing, with at least two conductor insertion openings for inserting electrical conductors, said conductor insertion openings are aligned next to one another in a connection plane, extend in a plug-in direction and lead from a connection side of the plug-type connector into the interior of the first insulating housing, with at least two mating contact receiving openings for receiving mating contacts of said mating plug-type connector, said mating contact receiving openings being aligned next to one another in a plug-in plane and extending from a plug-in side of the plug-type connector, which is opposite the connection side, into the interior of the first insulating housing, and with grooves in the first insulating housing which extend in the plug-in direction, the grooves are arranged offset with respect to the conductor insertion openings and the mating contact receiving openings and at least partially enter an interspace between two adjacent conductor insertion openings, and the grooves extend from the connection side to the plug-in side over the entire length of the plug-type connector, the mating plug type connector comprising:

a second insulating housing;

mating contacts, which extend in the second insulating housing parallel to one another at a distance in the plug-in direction; and guide webs for forming guides, wherein the guide webs are arranged in such a way that coding pins are guided and held by the guide webs between adjacent mating contacts, parallel to the plug-in plane, which is covered by the mating contacts and is aligned in the plug-in direction.

7. The mating plug-type connector according to claim 6, wherein clamping projections are in the guides, and the coding pins have, at one free end, a fork with two mutually spaced-apart clamping limbs, which are matched to the clamping projections in such a way that the clamping limbs of the fork engage around one of the clamping projections on both sides and fix each of the coding pins on each of the clamping projections.

8. A set of plug-type connectors comprising:

a plug type connector comprising:

a first insulating housing, with at least two conductor insertion openings for inserting electrical conductors, wherein said conductor insertion openings are aligned next to one another in a connection plane, extend in a plug-in direction and lead from a connection side of the plug-type connector into the interior of the first insulating housing;

at least two mating contact receiving openings for receiving mating contacts of a mating plug-type connector, wherein said mating contact receiving openings are aligned next to one another in a plug-in plane and extending from a plug-in side of the plug-type connector, which is opposite the connection side, into the interior of the first insulating housing; and grooves in the first insulating housing which extend in the plug-in direction, wherein the grooves are arranged offset with respect to the conductor insertion openings and the mating contact receiving openings and at least partially enter an interspace between two adjacent conductor insertion openings, and the grooves extend from the connection side to the plug-in side over the entire length of the plug-type connector; and said mating plug-type connector for mating with said plug-type connector comprising:

a second insulating housing;

said mating contacts, which extend in the second insulating housing parallel to one another at a distance in the plug-in direction; and guide webs for forming guides, wherein the guide webs are arranged in such a way that a first set of coding pins for the mating plug-type connector are guided and held by the guide webs between adjacent mating contacts, parallel to the plug-in plane, which is covered by the mating contacts and is aligned in the plug-in direction.

9. The set of plug-type connectors according to claim 8, wherein a second set of coding pins for the plug-type connector is configured differently from the first set of coding pins for the mating plug-type connector.

10. The set of plug-type connectors according to claim 9, wherein the mating plug-type connector has latching receptacles for receiving latching elements of the first set of coding pins, and the plug-type connector has latching receptacles for receiving latching elements of the second set of coding pins.

11. The set of plug-type connectors according to claim 10, wherein the contour of the grooves and guide webs for the first and second sets of coding pins and the contour of the first and second sets of coding pins and the latching elements of the first and second sets of coding pins, said latching elements being provided for latching on the plug-type connector and the mating plug-type connector, as well as the correspondingly matched design of the latching receptacles for the plug-type connector and the mating plug-type connector are configured differently from one another.

* * * * *